US008653917B2

(12) United States Patent
Takaya et al.

(10) Patent No.: US 8,653,917 B2
(45) Date of Patent: Feb. 18, 2014

(54) CONTACT DEVICE AND ELECTROMAGNETIC SWITCH USING CONTACT DEVICE

(75) Inventors: Kouetsu Takaya, Kounosu (JP); Kenji Suzuki, Kounosu (JP); Yasuhiro Naka, Kounosu (JP)

(73) Assignees: Fuji Electric FA Components & Systems Co., Ltd., Tokyo (JP); Fuji Electric Co., Ltd., Kawasaki-Shi (JP)

( * ) Notice: Subject to any disclaimer, the term of this patent is extended or adjusted under 35 U.S.C. 154(b) by 0 days.

(21) Appl. No.: 13/696,915

(22) PCT Filed: Jun. 14, 2011

(86) PCT No.: PCT/JP2011/003379

§ 371 (c)(1),
(2), (4) Date: Dec. 21, 2012

(87) PCT Pub. No.: WO2012/020529

PCT Pub. Date: Feb. 16, 2012

(65) Prior Publication Data

US 2013/0127571 A1 May 23, 2013

(30) Foreign Application Priority Data

Aug. 11, 2010 (JP) ..... 2010-180242

(51) Int. Cl.
*H01H 67/02* (2006.01)
*H01H 9/30* (2006.01)

(52) U.S. Cl.
USPC ..... 335/201; 335/131; 335/126

(58) Field of Classification Search
USPC ..... 335/126, 131, 201; 218/31, 110, 118
See application file for complete search history.

(56) References Cited

U.S. PATENT DOCUMENTS

| | | | | | |
|---|---|---|---|---|---|
| 2,725,446 | A | * | 11/1955 | Slepian | 218/26 |
| 3,082,307 | A | * | 3/1963 | Greenwood et al. | 218/30 |
| 3,174,019 | A | * | 3/1965 | Jansson | 218/10 |
| 4,424,428 | A | * | 1/1984 | Bernard et al. | 218/26 |
| 4,560,848 | A | * | 12/1985 | Arimoto | 218/23 |

(Continued)

FOREIGN PATENT DOCUMENTS

| | | | |
|---|---|---|---|
| JP | 3733537 | B2 | 10/2005 |
| JP | 2007-123058 | A | 5/2007 |
| JP | 2010-10057 | A | 1/2010 |

OTHER PUBLICATIONS

PCT, "International Search Report for PCT/JP2011/003379", Jul. 12, 2011.

*Primary Examiner* — Alexander Talpalatski
(74) *Attorney, Agent, or Firm* — Manabu Kanesaka

(57) ABSTRACT

A contact device includes a pair of fixed contactors fixed to one side of an insulation container with a predetermined space therebetween and having a columnar shape with a tip end contact surface protruding at lease inside the insulation container, and a movable contactor disposed to be capable of contacting with and separating from the pair of fixed contactors. Surfaces of the pair of fixed contactors facing the movable contactor are formed of annular peripheral walls having a concave part at a center thereof. An annular arc is formed between the annular peripheral wall and the movable contactor when the contact device is in an open state.

8 Claims, 3 Drawing Sheets

(56) References Cited

U.S. PATENT DOCUMENTS

| | | | | | |
|---|---|---|---|---|---|
| 4,637,267 | A | * | 1/1987 | Mazzorana | 74/7 A |
| 4,786,770 | A | * | 11/1988 | Hamano et al. | 218/23 |
| 5,394,128 | A | | 2/1995 | Perreira et al. | |
| 5,514,844 | A | * | 5/1996 | Hamano et al. | 218/57 |
| 5,519,370 | A | * | 5/1996 | Perreira et al. | 335/154 |
| 5,837,953 | A | * | 11/1998 | Ito et al. | 218/30 |
| 6,875,035 | B2 | * | 4/2005 | Sakiyama | 439/181 |
| 7,573,360 | B2 | * | 8/2009 | Bryan et al. | 335/201 |
| 8,274,007 | B2 | * | 9/2012 | Blalock et al. | 218/129 |

* cited by examiner

CONTACT DEVICE AND ELECTROMAGNETIC SWITCH USING CONTACT DEVICE

RELATED APPLICATIONS

The present application is National Phase of International Application No. PCT/JP2011/003379 filed Jun. 14, 2011, and claims priority from Japanese Application No. 2010-180242, filed Aug. 11, 2010.

TECHNICAL FIELD

The present invention relates to a contact device having a fixed contactor and a movable contactor interposed into a current path, and an electromagnetic switch that uses the contact device, the contact device being capable of easily extinguishing an arc that is generated when the fixed contactor and the movable contactor are opened, that is, when the current is interrupted.

BACKGROUND ART

Among conventional electromagnetic relays and electromagnetic contactors functioning as contact devices for opening/closing current paths, various contact mechanisms have been proposed for extinguishing an arc that is generated when movable contactors and fixed contactors are opened to be separated from each other, in order to bring a closed state of the contact mechanisms where the fixed contactor and the movable contactor are in contact with each other, to an open state by interrupting a current.

For example, there is proposed an electromagnetic relay that has a pair of fixed contactors disposed away from each other by a predetermined distance, a movable contactor disposed to be capable of contacting with and separating from the pair of fixed contactors, and an electromagnetic block that drives the movable contactor. A U-shaped magnetic holding member is positioned on the outside of a sealing container that faces either side surface in a position where the fixed contactors and the movable contactor face each other, and two pairs of permanent magnets are positioned on the inside of the magnetic holding member in order to extinguish an arc easily by stretching the arc using a magnetic force of the permanent magnets (see Patent Document 1, for example).

However, although the arc can be stretched and extinguished easily by the magnetic force of the permanent magnets, the prior art described in above-mentioned Patent Document 1 has a problem where the gap between the pair of fixed contactors and the movable contactor needs to be enlarged in order to reliably eliminate the arc. Another problem is that a U-shaped magnetic supporting member and two pairs of the permanent magnets supported by the magnetic supporting member are required on the outside of the sealing container, which results in an increase in the number of parts and assembly processes, as well as the production costs.

In order to solve such problems, a sealed relay device is proposed in which arc discharge is extinguished in a configuration where a flat section is formed at a tip end of a semicircular contact part between a fixed contactor and a movable contactor contacting the fixed contactor, a permanent magnet is embedded in a direction perpendicular or parallel to the flat section, and a magnetic flux is formed in a direction perpendicular to an arc that is generated when the sealed relay device is in an open state (see Patent Document 2, for example).

Patent Document 1: Japanese Patent Application Publication No. 2010-10057

Patent Document 2: Japanese Patent No. 3733637

DISCLOSURE OF THE INVENTION

However, the prior art Publications described in Patent Documents 1 and 2 have an unsolved problem where a permanent magnet is required to favorably extinguish an arc that is generated during the open state.

The present invention, therefore, was conceived in view of the unsolved problem of the prior art, and an object of the present invention is to provide a contact device capable of easily extinguishing an arc generated between a fixed contactor and a movable contactor without using a permanent magnet, the arc being generated when the contact device is in an open state, and an electromagnetic switch that uses this contact device.

In order to achieve the object described above, a first aspect of a contact device according to the present invention has: a pair of fixed contactors fixed to a surface of an insulation container with a predetermined space therebetween and each being shaped in a columnar form with at least a tip end contact surface protruding into the insulation container; and a movable contactor disposed to be capable contacting with and separating from the pair of fixed contactors. Surfaces of the pair of fixed contactors facing the movable contactor are configured by annular peripheral walls having concave parts at central parts thereof.

According to this configuration, surfaces of the columnar fixed contactors that face the movable contactor are configured by annular peripheral walls having concave parts at central parts thereof. Thus, an annular arc is generated between the movable contactor and the surfaces of the annular peripheral walls facing the movable contactor, in the open state where the fixed contactors and the movable contactor separate from each other. This annular arc is cooled by being rotated in a circumferential direction by a magnetic field of a current passing through the fixed contactors. Therefore, the arc can be extinguished, without using a permanent magnet.

In a second aspect of the contact device according to the present invention, arc extinguishing permanent magnets configured to drive an arc to the outside of the fixed contactors are attached to the concave parts, the arc being generated when the contact device is in an open state.

According to this configuration, the arc that is rotated in the circumferential direction can be driven to the outside by the arc extinguishing permanent magnets. Therefore, the arc can be extinguished reliably.

In a third aspect of the contact device according to the present invention, parts of the arc extinguishing permanent magnets on the movable contactor side are magnetized to an N-pole.

According to this configuration, the parts of the arc extinguishing permanent magnets on the movable contactor side are magnetized to an N-pole. This results in creating a magnetic force that reaches an S-pole from the N-pole through the outside of the permanent magnets, and in driving the annular arc generated during an open state of the contact device, to the outside of the arc extinguishing permanent magnets.

In a fourth aspect of the contact device according to the present invention, the insulation container is an airtight container sealing a gas therein.

According to this configuration, the fixed contacts and the movable contact are disposed within the airtight container sealing a gas. Thus, the arc can be eliminated reliably.

An aspect of an electromagnetic switch according to the present invention has the contact device of any one of the first to fourth aspects described above, and is characterized in that the movable contactor is coupled to a movable core of an operation electromagnet, and the fixed contactors are respectively connected to external connection terminals.

This configuration can provide an electromagnetic switch that is capable of extinguishing an arc using a simple structure, the arc being generated when the electromagnetic switch is in an open state.

According to the present invention, the surfaces of the columnar fixed contactors facing the movable contactor are configured by the annular peripheral walls having the concave parts at the central parts thereof. Thus, an annular arc is generated between the movable contactor and the surfaces of the annular peripheral walls facing the movable contactor, in the open state where the fixed contactors and the movable contactor separate from each other. This annular arc is cooled by being rotated in the circumferential direction by a magnetic field of a current passing through the fixed contactors. Therefore, the arc can be extinguished, without using a permanent magnet.

Because the arc extinguishing permanent magnet for driving the arc outwardly is disposed within the concave part, the arc can be extinguished more reliably.

Moreover, applying the contact device having the above-mentioned effect to the electromagnetic switch can provide an electromagnetic switch such as an electromagnetic contactor or an electromagnetic relay, which is capable of extinguishing an arc using a simple structure, the arc being generated when the electromagnetic switch is in an open state.

BRIEF DESCRIPTION OF THE DRAWINGS

FIG. 2(*b*) is a cross-sectional diagram taken along line A-A of FIG. 2(*a*)

BEST MODE FOR CARRYING OUT THE INVENTION

An embodiment of the present invention is described hereinafter with reference to the diagrams.

Figure 1:
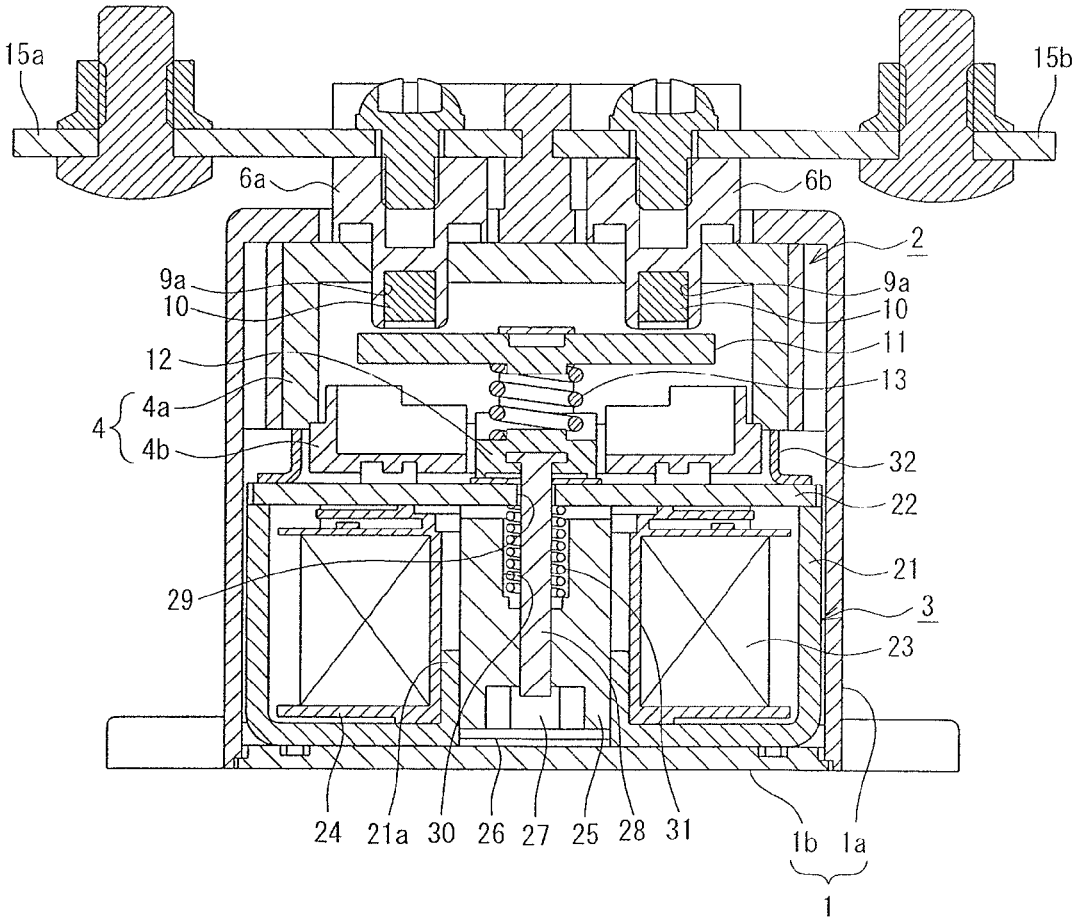
FIG. 1 is a cross-sectional diagram showing a first embodiment in which the present invention is applied to an electromagnetic contactor.

FIG. 1 is a cross-sectional diagram showing an example in which a contact device of the present invention is applied to an electromagnetic contactor functioning as an electromagnetic switch. In FIG. 1, reference numeral 1 represents an outer case made from, for example, a synthetic resin. This outer case 1 is configured by a tubular body 1*a* having an opened lower end surface, and a bottom plate 1*b* that closes the lower end surface of the tubular body 1*a*.

Within the outer case 1, a contact device 2 in which a contact mechanism is disposed, and an electromagnetic unit 3 serving as an electromagnetic device for driving the contact device 2 are stored in a manner that the electromagnetic unit 3 is positioned on the bottom plate 1*b*.

Figure 2A:
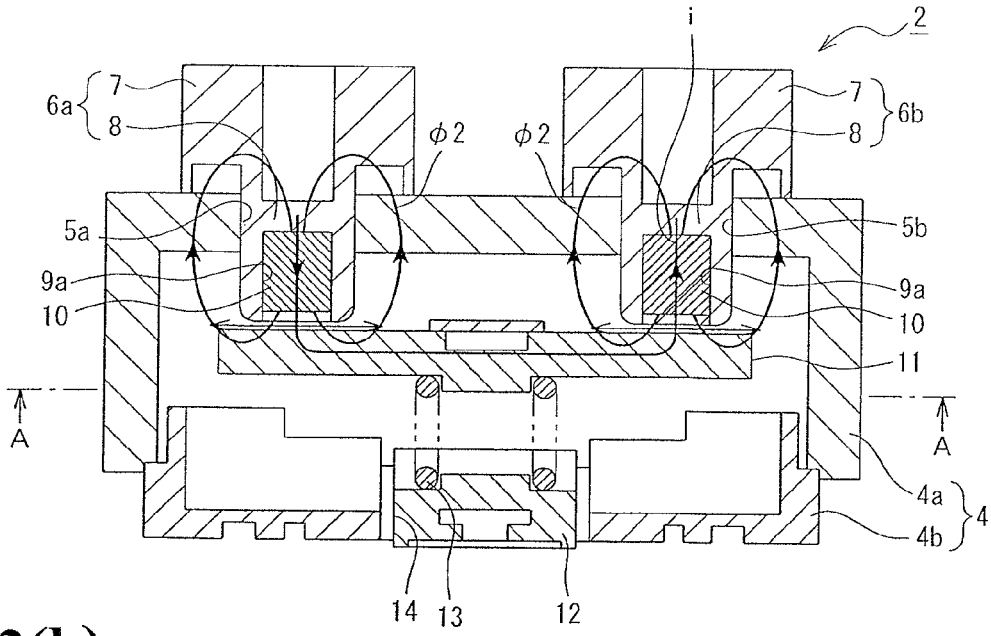
FIG. 2(*a*) is an enlarged cross-sectional diagram of a contact device of the present invention.
Figure 2B:
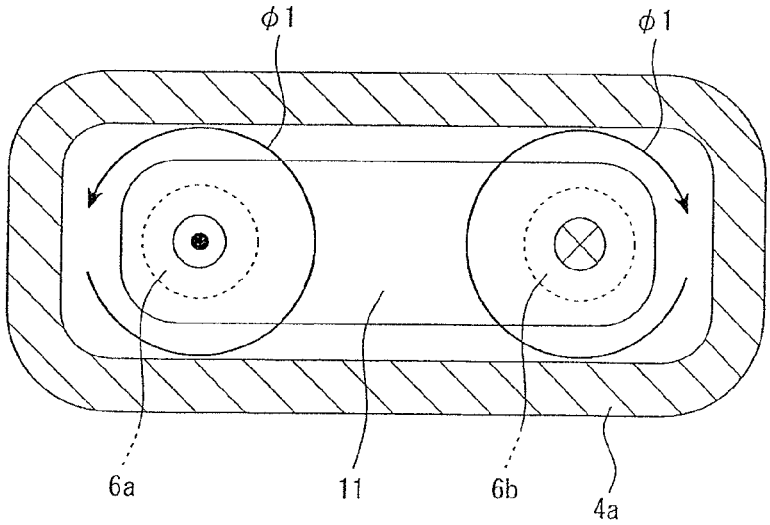
Figure 3:
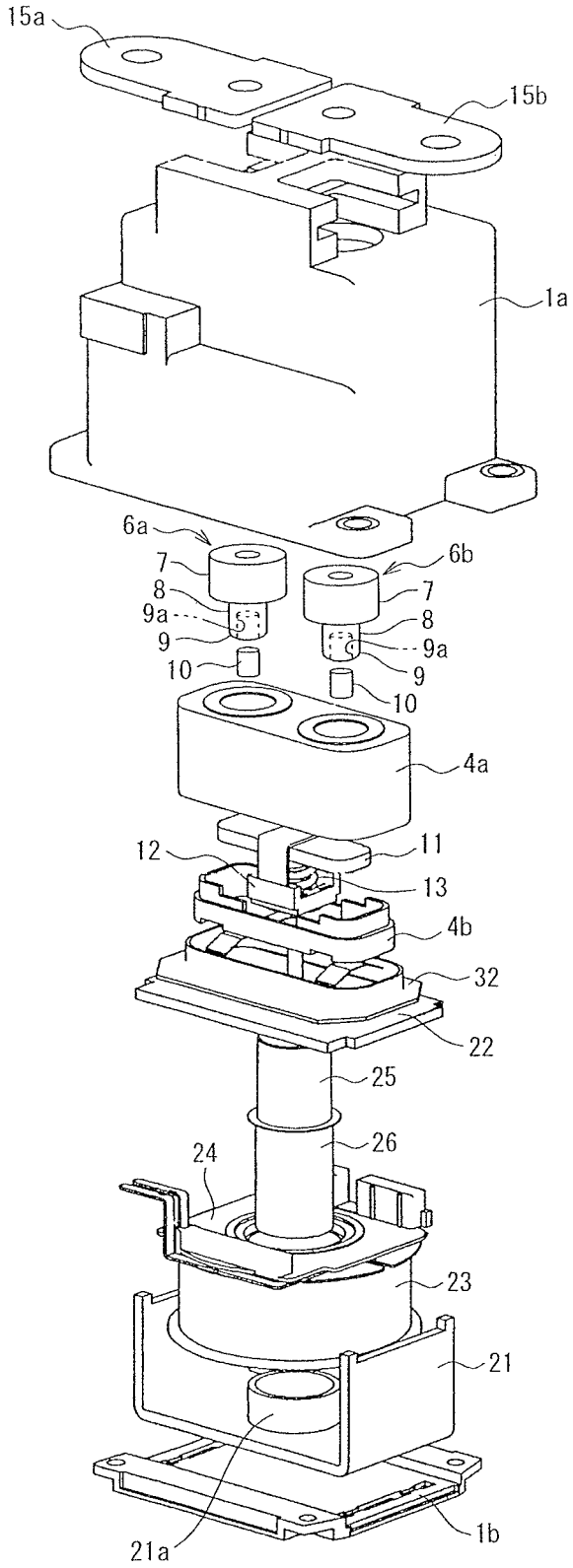
FIG. 3 is an exploded perspective view of an electromagnetic contactor according to the present invention.

As is clear from FIGS. 2 and 3, the contact device 2 has an insulation airtight container 4 that has a dual structure of substantially cuboid upper and lower cases 4*a* and 4*b* having opened lower ends. An upper surface of the insulation airtight container 4 is provided with through-holes 5*a*, 5*b* with circular cross sections, disposed in a longitudinal direction with a predetermined space therebetween. A pair of fixed contactors 6*a*, 6*b*, made from copper, for example, is inserted into the through-holes 5*a*, 5*b* and fixed thereto by an adhesive or the like.

As shown in FIG. 2(*a*), each of the fixed contactors 6*a*, 6*b* is configured by a large-diameter head part 7 provided in an upper part and a small-diameter cylinder part 8 provided in a lower part and joined coaxially to the large-diameter head part 7. Lower end surfaces of the small-diameter cylinder parts 8, which face a movable contactor 11 described hereinafter, are configured by annular peripheral walls 9 in which concave parts 9*a* with a circular cross section are formed at central parts thereof. A cylindrical arc extinguishing permanent magnet 10 is attached and fixed, by means of an adhesive or the like, to the inside of each concave part 9*a* forming the annular peripheral wall 9. The arc extinguishing permanent magnets 10 are magnetized in an axial direction such that lower surfaces thereof on the movable contactor 11 are magnetized to an N-pole and the large-diameter head part 7 side to an S-pole.

Lower end surfaces of the arc extinguishing permanent magnets 10 are positioned to be located higher than lower end surfaces of the small-diameter cylinder parts 8 of the fixed contactors 6*a*, 6*b*, but may be positioned to be flush with lower surfaces of the small-diameter cylinder parts 8. In other words, as described hereinafter, the height of the lower end surfaces of the arc extinguishing permanent magnets 10 is not particularly limited as long as an arc can be driven to the outside of each annular peripheral wall 9 when the arc is generated during an open state of the contact device.

The fixed contactors 6*a*, 6*b* are fixed to the upper case 4*a* by an adhesive or the like to seal the through-holes 5*a*, 5*b*, while the small-diameter cylinder parts 8 are inserted into the through-holes 5*a*, 5*b* of the upper case 4*a*.

In the contact device 2, the flat movable contactor 11 is disposed facing the lower end surfaces of the small-diameter cylinder parts 8 of the fixed contactors 6*a*, 6*b*, with a predetermined short gap therewith, to be capable of contacting with and separating from these lower end surfaces. This movable contactor 11 is urged upward by a contact spring 13 and attached to a contactor holder 12.

The contactor holder 12 is inserted into an insertion hole formed in the lower case 4*b*, and guided in a vertical direction. The contactor holder 12 is coupled to a movable core of the electromagnetic unit 3, which is described hereinafter, and then driven in the vertical direction.

The insulation airtight container 4 configured by the upper case 4*a* and the lower case 4*b* encapsulates gas therein.

Furthermore, external connection terminal strips 15*a*, 15*b* are screwed to the large-diameter head parts 7 of the fixed contactors 6*a*, 6*b*.

As shown in FIGS. 1 and 3, the electromagnetic unit 3 has a magnetic yoke 21 that is in a U-shape as viewed laterally. A tubular part 21*b* having an opened lower end is formed in a central part of a bottom plate part 21*a* of the magnetic yoke 21. An upper surface of the magnetic yoke 21 is joined to an upper surface magnetic yoke 22.

A coil holder 24 having an exciting coil 23 wrapped therearound is attached to an outer circumferential surface of the tubular part 21*b* of the magnetic yoke 21, and a bottomed tubular cap 26 that has a movable core 25 installed slidably therein is disposed on an inner circumferential surface of the tubular part 21*b*. A rubber seat 27, which absorbs an impact of the falling of the movable core 25 by contacting with a bottom surface of the movable core 25, is disposed on a bottom surface of the cap 26.

A coupling shaft 28 is fitted to a central part of the movable core 25. A head part of the coupling shaft 28 is extended upward via a through-hole 29 formed in the upper surface magnetic yoke 22, and is coupled to the contactor holder 12.

Moreover, a spring insertion hole 30 is formed around the coupling shaft 28 of the movable core 25, and a return spring 31 for urging the movable core 25 downward is attached between the spring insertion hole 30 and the upper surface magnetic yoke 22.

In addition, the insulation airtight container 4 and the upper surface magnetic yoke 22 are bonded to each other by a bonding member 32.

Operations of the embodiment are described next.

Suppose that the external connection terminal strip 15*a* is connected to, for example, a power supply source for supplying a large current, and that the external connection terminal strip 15*b* is connected to a load.

Suppose, in this state, that the exciting coil 23 of the electromagnetic unit 3 is in a non-power-supply state and that no excitation force is generated in the electromagnetic unit 3 for moving the movable core 25. In this state, the movable core 25 is urged by the return spring 31 in a downward direction to separate from the upper surface magnetic yoke 22 and abutting against the rubber seat 27. Therefore, the movable contactor 11, which is supported by the contactor holder 12 that is coupled to the movable core 25 by the coupling shaft 28, faces the lower end surfaces of the small-diameter cylinder parts 8 of the fixed contactors 6*a*, 6*b* with the predetermined short gap therewith, and the contact device 2 is opened.

In this open state of the contact device 2, applying a voltage to the exciting coil 23 of the electromagnetic unit 3 produces the excitation force in the electromagnetic unit 3, pushing the movable core 25 upward against the return spring 31. In response to this, the contactor holder 12 that is coupled to the movable core 25 by the coupling shaft 28 moves upward, and the movable contactor 11 contacts with bottom surfaces of the small-diameter cylinder parts 8 of the fixed contactors 6*a*, 6*b* by contact pressure of the contact spring 13.

As a result, the contact device 2 enters a closed state in which a large current i of an external power supply source is supplied to the load via the external connection terminal strip 15*a*, the fixed contactor 6*a*, the movable contactor 11, the fixed contactor 6*b*, and the external connection terminal strip 15*b*.

When interrupting the supply of current to the load in this closed state of the contact device 2, the application of voltage to the exciting coil 23 of the electromagnetic unit 3 is stopped.

Consequently, the excitation force for moving the movable core 25 upward disappears in the electromagnetic unit 3, whereby the movable core 25 is dropped by the urging force of the return spring 31. This falling of the movable core 25 drops the contactor holder 12 that is coupled thereto by the coupling shaft 28. Accordingly, the movable contactor 11 stays in contact with the fixed contactors 6*a*, 6*b*, while the contact pressure is applied to the movable contactor 11 by the contact spring 13. Thereafter, as soon as the contact pressure of the contact spring 13 disappears, the contact device 2 enters the open state in which the movable contactor 11 separates downward from the fixed contactors 6*a*, 6*b*.

In this open start state, an arc is generated between the fixed contactors 6*a*, 6*b* and the movable contactor 11. At this moment, the arc forms an annular shape because the contact surfaces between the fixed contactors 6*a*, 6*b* and the movable contactor 11 are configured by the annular peripheral walls 9 in which the concave parts 9*a* are formed in the central parts thereof. Moreover, because the high current flows downward through the fixed contactor 6*a*, a magnetic field of a self current path of the fixed contactor 6*a* generates a counterclockwise magnetic flux $\phi$1, as shown in FIG. 2(*b*). This magnetic flux $\phi$1 rotates the arc in the circumferential direction, facilitating the cooling of the arc (energy absorption).

Moreover, the columnar arc extinguishing permanent magnets 10 are fixed to the inside of the concave parts 9*a* that are formed on the surfaces of the fixed contactors 6*a*, 6*b* facing the movable contactor 11. In each of the arc extinguishing permanent magnets 10, the lower end side thereof on the movable contactor 11 side is magnetized to the N-pole, and the upper end side thereof is magnetized to the S-pole. This results in forming a magnetic flux $\phi$2 that reaches the S-pole on the upper end side of the arc extinguishing permanent magnet 10 from the N-pole side of the lower end through the outside of the arc extinguishing permanent magnet 10, as shown in FIG. 2(*a*). Therefore, the arc is driven to the outside of the arc extinguishing permanent magnets 10 in accordance with Fleming's left-hand rule due to the magnetic flux $\phi$2 of the arc extinguishing permanent magnets 10 and the current flowing through the fixed contactors 6*a*, 6*b*, eliminating the arc within a shorter period of time.

According to the present embodiment described above, the annular peripheral walls 9 in which the concave parts 9*a* are formed in the central parts thereof are formed on the surfaces of the fixed contactors 6*a*, 6*b* facing the movable contactor 11. Therefore, an annular arc is formed during the open state of the contact device where the fixed contactors 6*a*, 6*b* separate from the movable contactor 11. The annular arc is rotated in the circumferential direction by the magnetic flux $\phi$1 of the current passing through the fixed contactors 6*a*, 6*b*, facilitating the cooling of the arc (energy absorption). As a result, the arc can be extinguished reliably without using the arc extinguishing permanent magnets 10.

In addition, positioning the arc extinguishing permanent magnets 10 in the concave parts 9*a* can reliably extinguish the art within a shorter period of time. In this case, it is only necessary to position and fix the arc extinguishing permanent magnets 10 in the concave parts 9*a* by means of an adhesive or the like, allowing an easy attachment of the arc extinguishing permanent magnets 10 to the fixed contactors 6*a*, 6*b*. Alternatively, the concave parts 9*a* can be, for example, cut and formed coaxially with the central axes of the fixed contactors 6*a*, 6*b*. Accordingly, the arc extinguishing permanent magnets 10 can also be reliably positioned coaxially with the central axes of the fixed contactors 6*a*, 6*b*.

Moreover, precisely extinguishing the arc can narrow the gap between the fixed contactors 6*a*, 6*b* and the movable contactor 11 and reduce an open time period for interrupting the current.

Note that the present embodiment has described the case in which the fixed contactors 6*a*, 6*b* are configured by the large-diameter head parts 7 and the small-diameter cylinder parts 8, but the present invention is not limited thereto; therefore, the entire fixed contactors 6*a*, 6*b* may be formed into cylinders.

The cross-sectional shape of the small-diameter cylinder parts 8 of the fixed contactors 6*a*, 6*b* is not limited to a circular shape; therefore, the cross-sectional shape of the small-diameter cylinder parts 8 can be any shape, including ellipses and squares, and in accordance with this, the cross-sectional shape of the concave parts 9*a* and the arc extinguishing permanent magnets 10 may be changed to an identical shape.

Furthermore, the present embodiment has described the case in which the arc extinguishing permanent magnets 10 are positioned in the concave parts 9*a* of the fixed contactors 6*a*, 6*b*, but sufficient arc extinction performance can be still accomplished without providing the arc extinguishing permanent magnets 10.

Moreover, the present embodiment has described the case in which the insulation airtight container 4 functioning as an arc-extinguishing chamber sealing a gas therein, but the present invention is not limited thereto; therefore, the gas may not be sealed.

In addition, the present embodiment has described the case in which the movable contactor 11 is formed flat, but the present invention is not limited thereto; therefore, a central part between contact points of the movable contactor 11 that face the fixed contactors 6*a*, 6*b* may be shaped into a concave or a convex.

The configuration of the electromagnetic unit 3 is not limited to the present embodiment; therefore, any configuration can be applied as long as the contactor holder 12 can be moved electromagnetically.

Moreover, the present embodiment has described the case in which the contact device 2 of the present invention is applied to an electromagnetic contactor, but the present invention is not limited thereto; therefore, the contact device 2 can be applied to an electromagnetic relay or any switches, including an electromagnetic switch.

INDUSTRIAL APPLICABILITY

The present invention can provide a contact device in which the surfaces of the fixed contactors facing the movable contactor are configured by the annular peripheral walls having the concave parts in the central parts thereof. In the contact device having such a configuration, an annular arc is generated between the movable contactor and the surfaces of the annular peripheral walls that face the movable contactor when the contact device is in the open state. This contact device can cool the annular arc by rotating the arc in the circumferential direction by means of the magnetic field of the current flowing through the fixed contactors, and thereby extinguish the arc. The present invention can also provide an electromagnetic switch that uses this contact device.

EXPLANATION OF REFERENCE NUMERALS

1 . . . Outer case, 2 . . . Contact device, 3 . . . Electromagnetic unit, 4 . . . Insulation airtight container, 4*a* . . . Upper case, 4*b* . . . Lower case, 6*a*, 6*b* . . . Fixed contact, 7 . . . Large-diameter head part, 8 . . . Small-diameter cylinder part, 9 . . . Concave part, 10 . . . Arc extinguishing permanent magnet, 11 . . . Movable contact, 12 . . . Contactor holder, 13 . . . Contact spring, 15*a*, 15*b* . . . External connection terminal strip, 21 . . . Magnetic yoke, 22 . . . Upper surface magnetic yoke, 23 . . . Exciting coil, 24 . . . Coil holder, 25 . . . Movable core, 26 . . . Cap, 28 . . . Coupling shaft, 31 . . . Return spring

What is claimed is:

1. A contact device, comprising:

a pair of fixed contactors fixed to one side of an insulation container with a predetermined space therebetween, each having a columnar shape portion including an annular peripheral wall and a concave part formed inside the annular peripheral wall, the concave part being formed on a center of the columnar shape portion and extending from one end of the columnar shape portion toward the other end of the columnar shape portion, at least the one end of the columnar shape portion being disposed inside the insulation container;

a pair of arc extinguishing permanent magnets, each being arranged in the concave part of the fixed contactor; and a movable contactor contacting with and separating from the pair of fixed contactors, wherein each of the fixed contactors includes one permanent magnet, which is entirely embedded in one concave portion such that the permanent magnet directly faces the movable contact, and that a lower surface of the annular peripheral wall is flush with a lower end surface of the permanent magnet or projects outwardly from the lower end surface of the permanent magnet.

2. The contact device according to claim 1, wherein the arc extinguishing permanent magnet is configured to drive an arc being generated when a contact device becomes an open state, to outside of the fixed contactor.

3. The contact device according to claim 2, wherein one end portion of the arc extinguishing permanent magnet facing the movable contactor is magnetized to an N-pole.

4. The contact device according to claim 1, wherein the insulation container is an airtight container sealing a gas therein.

5. An electromagnetic switch, comprising the contact device of claim 1, an electromagnetic device including a movable core; and a pair of external connection terminals, wherein the movable contactor is coupled to the movable core of the electromagnetic device, and the pair of fixed contactors is connected to the pair of external connection terminals.

6. The contact device according to claim 1, wherein the movable contactor is flat and is disposed to face the lower end surfaces of the fixed contactors so that the movable contactor directly contacts the lower surface of the annular peripheral wall.

7. The contact device according to claim 6, wherein one end portion of the permanent magnet facing the movable contactor is magnetized to an N-pole and the other end portion of the permanent magnet is magnetized to an S-pole, such that a magnetic flux is outwardly generated form the one end of the permanent magnet to the other end of the permanent magnet through an outside of the permanent magnet to drive an arc generated when the movable contactor moves away from the pair of fixed contactors, to outside of the permanent magnet.

8. The contact device according to claim 7, wherein when the movable contactor contacts the fixed contactor, a current flows from the other end of the columnar shape portion toward the one end of the columnar shape portion at one of the pair of the fixed contactors to generate another magnetic flux rotating around the fixed contactor so that when the movable contactor moves away from the fixed contactors, the another magnetic flux rotates the arc generated in one circumferential direction; and when the movable contactor contacts the fixed contactor, the current flows from the one end of the columnar shape portion toward the other end of the columnar shape portion to generate a further magnetic flux at another of the pair of the fixed contactors, and when the arc is generated, the further magnetic flux rotates the arc in another circumferential direction.

* * * * *

UNITED STATES PATENT AND TRADEMARK OFFICE

CERTIFICATE OF CORRECTION

PATENT NO. : 8,653,917 B2
APPLICATION NO. : 13/696915
DATED : February 18, 2014
INVENTOR(S) : Kouetsu Takaya et al.

It is certified that error appears in the above-identified patent and that said Letters Patent is hereby corrected as shown below:

In the Specification

Please change column 4, line 39 to 40, “hole formed” to --hole 14 formed--.

Signed and Sealed this
Twenty-seventh Day of May, 2014

Michelle K. Lee

Michelle K. Lee
*Deputy Director of the United States Patent and Trademark Office*